US011988446B2

(12) United States Patent
Briglia et al.

(10) Patent No.: US 11,988,446 B2
(45) Date of Patent: May 21, 2024

(54) METHOD AND APPARATUS FOR PRODUCING HIGH-PURITY NITROGEN AND LOW-PURITY OXYGEN

(71) Applicant: L'Air Liquide, Societe Anonyme pour l'Etude et l'Exploitation des Procedes Georges Claude, Paris (FR)

(72) Inventors: Alain Briglia, Hangzhou (CN); Huali Xie, Hangzhou (CN); Yongshun Zhang, Hangzhou (CN)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 190 days.

(21) Appl. No.: 17/469,823

(22) Filed: Sep. 8, 2021

(65) Prior Publication Data

US 2022/0090855 A1 Mar. 24, 2022

(30) Foreign Application Priority Data

Sep. 18, 2020 (CN) ..... 202010985907.3

(51) Int. Cl.
*F25J 3/04* (2006.01)

(52) U.S. Cl.
CPC ..... *F25J 3/04448* (2013.01); *F25J 3/04084* (2013.01); *F25J 3/0409* (2013.01); *F25J 3/0423* (2013.01); *F25J 3/04436* (2013.01); *F25J 3/04454* (2013.01); *F25J 2200/08* (2013.01); *F25J 2210/40* (2013.01); *F25J 2215/42* (2013.01); *F25J 2215/50* (2013.01); *F25J 2235/02* (2013.01); *F25J 2235/42* (2013.01); *F25J 2235/50* (2013.01)

(58) Field of Classification Search
CPC ..... F25J 3/0409; F25J 3/0423; F25J 3/0429; F25J 3/04454; F25J 3/04436; F25J 3/04448; F25J 2200/08
See application file for complete search history.

(56) References Cited

U.S. PATENT DOCUMENTS

| | | | | |
|---|---|---|---|---|
| 5,078,766 | A | 1/1992 | Guilleminot | |
| 2008/0110203 | A1* | 5/2008 | May | F25J 3/04866 62/643 |
| 2014/0109614 | A1* | 4/2014 | Tachibana | F25J 3/04303 62/643 |
| 2016/0245586 | A1* | 8/2016 | Davidian | F25J 3/0409 |

(Continued)

FOREIGN PATENT DOCUMENTS

| | | |
|---|---|---|
| CN | 102 003 867 | 4/2011 |
| CN | 205 079 543 | 3/2016 |
| CN | 105 783 424 | 7/2016 |

(Continued)

*Primary Examiner* — John F Pettitt, III
(74) *Attorney, Agent, or Firm* — Justin K. Murray

(57) ABSTRACT

A method and apparatus for producing high-purity nitrogen and low-purity oxygen using three-column rectification are provided, in which: nitrogen and oxygen undergo rectification in different columns, with high-purity nitrogen and low-purity oxygen being separated out of air simultaneously, thereby overcoming the shortcomings of conventional low-purity oxygen production equipment, and also reducing equipment investment, lowering energy consumption, increasing product added value, and realizing a circular economy effect.

10 Claims, 1 Drawing Sheet

(56) References Cited

U.S. PATENT DOCUMENTS

| | | | | |
|---|---|---|---|---|
| 2017/0299261 | A1* | 10/2017 | Narinsky | F25J 3/04393 |
| 2021/0381761 | A1* | 12/2021 | Kunz | F25J 3/04096 |

FOREIGN PATENT DOCUMENTS

| | | | | |
|---|---|---|---|---|
| CN | 107 940 896 | | 4/2018 | |
| CN | 109 163 506 | | 1/2019 | |
| DE | 10238282 | A1 * | 5/2003 | F25J 3/0409 |
| DE | 202009004099 | U1 * | 7/2009 | F25J 3/04084 |
| EP | 0 410 831 | | 1/1991 | |
| EP | 1199532 | A1 * | 4/2002 | F25J 3/04018 |
| EP | 2662654 | A1 * | 11/2013 | F25J 3/04054 |
| JP | 11132652 | A * | 5/1999 | F25J 3/04193 |

* cited by examiner

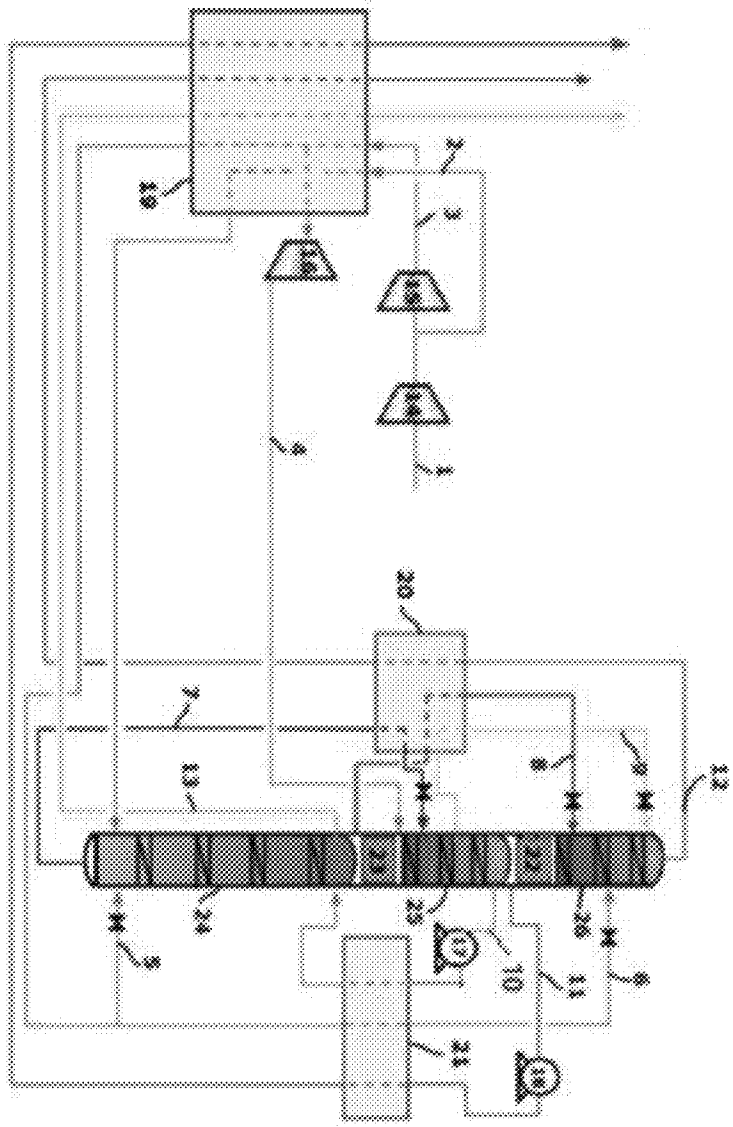
19
2
3
16
14
3
18
9
20
7
12
9
8
13
26
22
23
24
9
11
10
17
25
21
15

METHOD AND APPARATUS FOR PRODUCING HIGH-PURITY NITROGEN AND LOW-PURITY OXYGEN

CROSS REFERENCE RELATED APPLICATIONS

This application claims the benefit of priority under 35 U.S.C. § 119 (a) and (b) to Chinese patent application No. CN202010985907.3, filed Sep. 18, 2020, the entire contents of which are incorporated herein by reference.

TECHNICAL FIELD

The present invention relates to the field of low-temperature air separation, in particular to a method and apparatus for producing high-purity nitrogen and low-purity oxygen simultaneously using air as a feedstock

BACKGROUND ART

Two-column rectification is a conventional procedure in air separation equipment, which is suitable for the production of high-purity oxygen (higher than 99.5%). For the production of low-purity oxygen needed for oxygen-enriched combustion, the reduction in oxygen purity should theoretically be matched to a procedure with reduced work of separation and reduced oxygen production energy consumption. Thus, it is not possible to continue using the air separation procedure of the conventional system for production; instead, a novel apparatus should be invented and researched from the perspectives of rectification and procedure organization, etc., in order to reduce the power consumption of oxygen production.

In the prior art, a method in which high-purity oxygen is mixed with air is used; specifically, taking two columns as a starting point, a column is added in which high-purity oxygen is evaporated directly using air, followed by mixing to achieve the required low-purity oxygen concentration. Essentially, this is still conventional two-column rectification. Moreover, such a method of separating followed by mixing is undoubtedly a waste of energy, and the low-purity nitrogen produced as a by-product thereof cannot be directly conveyed; a nitrogen compressor must be added, and this entails an additional outlay in terms of the investment needed for the equipment itself.

In view of the above, in order to meet the requirements of energy conservation and emissions reduction, the question of how to design an air separation method and apparatus for the direct production of pressurized high-purity nitrogen and low-purity oxygen with a high extraction rate, to eliminate the deficiencies and shortcomings of high energy consumption and poor economy in the prior art, is an issue that is in urgent need of a solution from those skilled in the art.

SUMMARY OF THE INVENTION

Certain embodiments of the present invention provide a method for producing high-purity nitrogen and low-purity oxygen simultaneously using air as a feedstock; using three-column rectification, nitrogen and oxygen undergo rectification in different columns, with high-purity nitrogen and low-purity oxygen being separated out of air simultaneously, thereby overcoming the shortcomings of conventional low-purity oxygen production equipment, and also reducing equipment investment, lowering energy consumption, increasing product added value, and realizing a circular economy effect.

To achieve the above mentioned object of the invention, certain embodiments of the present invention disclose a method for producing high-purity nitrogen and low-purity oxygen, in which method, feedstock air is cooled in a main heat exchanger and led into a rectification system for nitrogen/oxygen separation, the rectification system having at least a high-pressure column and a low-pressure column, an oxygen stream is collected from a lower region of the low-pressure column, heated in the main heat exchanger and obtained as a pressurized oxygen product, a first nitrogen stream is collected from a top region of the high-pressure column, heated in the main heat exchanger and obtained as a pressurized nitrogen product, waste nitrogen is collected in the gaseous state from a top region of the low-pressure column and heated in the main heat exchanger, and served as regenerated gas or is vented, wherein:

a medium-pressure column is provided between the high-pressure column and low-pressure column, with the operating pressure of the medium-pressure column being between that of the high-pressure column and that of the low-pressure column, the lower region of the low-pressure column has a low-pressure condensing evaporator formed as a condensing evaporator, a lower region of the medium-pressure column has a medium-pressure condensing evaporator formed as a condensing evaporator, the rectification system comprises at least two subcoolers, specifically a high-pressure subcooler and a low-pressure subcooler, feedstock air passing through a first pressurizer is pressurized to a first pressure air, and after pre-cooling and purification, a first portion of the first pressure air is cooled in the main heat exchanger and led into a lower region of the high-pressure column, and a second portion of the first pressure air is pressurized in a second pressurizer to the second pressure air;

a first portion of the second pressure air is cooled in the main heat exchanger and collected from a middle position of the main heat exchanger, and then passes through an expander to obtain the third pressure air which is led into the lower region of the medium-pressure column, and a second portion of the second pressure air is liquefied or undergoes pseudo-liquefaction at supercritical pressure in the main heat exchanger, one portion of the second portion of the second pressure air which has been liquefied or has undergone pseudo-liquefaction at supercritical pressure is led into the lower region of the high-pressure column, another portion of the second portion of the second pressure air which has been liquefied or has undergone pseudo-liquefaction at supercritical pressure passes through the high-pressure subcooler and is led into a middle region of the low-pressure column, high-pressure oxygen-rich liquid air is collected from the bottom of the high-pressure column, passes through the low-pressure subcooler and is then throttled and led into a middle region of the medium-pressure column; medium-pressure oxygen-rich liquid air is collected from the medium-pressure condensing evaporator, passes through the low-pressure subcooler and is then throttled and led into the lower region of the low-pressure column; lean liquid nitrogen is collected from the middle region of the medium-pressure column, passes through the low-pressure subcooler and is then throttled and led into an upper region of the low-pressure column, a second nitrogen stream is collected from an upper region of the medium-pressure column, undergoes a pressure increase in the liquid state, passes through the high-pressure subcooler and is led into the top region of the high-pressure column.

In optional embodiments:

the pressure increase of the second nitrogen stream in the liquid state is accomplished by a liquid nitrogen pump;

the oxygen stream is collected in the liquid state from the low-pressure condensing evaporator, undergoes a pressure increase in the liquid state, and evaporates or undergoes pseudo-evaporation at supercritical pressure by indirect heat exchange with feedstock air in the main heat exchanger;

the pressure increase of the oxygen stream in the liquid state is accomplished by a liquid oxygen pump;

the pressurized oxygen product has a purity of 93%-99%; and/or the low-pressure column has an operating pressure of 1.1-1.5 bar, the medium-pressure column has an operating pressure of 4.5-6.5 bar, and the high-pressure column has an operating pressure of 8.5-9.5 bar, all of the above pressure values being absolute pressures.

Certain embodiments of the present invention also discloses an apparatus for producing high-purity nitrogen and low-purity oxygen, the apparatus having a rectification system for nitrogen/oxygen separation, and the rectification system having at least a high-pressure column and a low-pressure column, wherein the apparatus further comprises:

a main heat exchanger for cooling compressed and purified feedstock air, a component for collecting an oxygen stream from a lower region of the low-pressure column, the oxygen stream being heated in the main heat exchanger and obtained as a pressurized oxygen product, a component for collecting a first nitrogen stream from a top region of the high-pressure column, the first nitrogen stream being heated in the main heat exchanger and obtained as a pressurized nitrogen product, a component for collecting the waste nitrogen in the gaseous state from a top region of the low-pressure column, the waste nitrogen being heated in the main heat exchanger, and serving as regenerated gas or being vented, a medium-pressure column, arranged between the high-pressure column and the low-pressure column, a low-pressure condensing evaporator, arranged at the lower region of the low-pressure column, a medium-pressure condensing evaporator, arranged at a lower region of the medium-pressure column, a first pressurizer for pressurizing feedstock air to a first pressure, a component for leading a first portion of the first pressure air into a lower region of the high-pressure column after being cooled in the main heat exchanger, a second pressurizer for pressurizing a second portion of the first pressure air to a second pressure, an expander for expanding a first portion of the second pressure air to a third pressure air, a component for leading the third pressure air into the lower region of the medium-pressure column, a component for subjecting a second portion of the second pressure air to liquefaction or pseudo-liquefaction at supercritical pressure, a component for leading one portion of the second portion of the second pressure air which has been liquefied or has undergone pseudo-liquefaction at supercritical pressure into the lower region of the high-pressure column, a component for leading another portion of the second portion of the second pressure air which has been liquefied or has undergone pseudo-liquefaction at supercritical pressure through a high-pressure subcooler and into a middle region of the low-pressure column, a low-pressure subcooler, for subcooling the high-pressure oxygen-rich liquid air, medium-pressure oxygen-rich liquid air and lean liquid nitrogen, a high-pressure subcooler, for subcooling the other portion of the second portion of the second pressure air which has been liquefied or has undergone pseudo-liquefaction at supercritical pressure, a component for collecting the high-pressure oxygen-rich liquid air from the bottom of the high-pressure column, passing same through the low-pressure subcooler, throttling same and leading same into a middle region of the medium-pressure column, a component for collecting medium-pressure oxygen-rich liquid air from the medium-pressure condensing evaporator, passing same through the low-pressure subcooler, throttling same and leading same into the lower region of the low-pressure column, a component for collecting lean liquid nitrogen from the middle region of the medium-pressure column, passing same through the low-pressure subcooler, throttling same and leading same into an upper region of the low-pressure column, a component for collecting a second nitrogen stream from an upper region of the medium-pressure column, subjecting same to a pressure increase in the liquid state, passing same through the high-pressure subcooler and leading same into the top region of the high-pressure column.

In optional embodiments:

the apparatus further comprises a liquid nitrogen pump, for accomplishing the pressure increase of the second nitrogen stream in the liquid state;

the apparatus further comprises a liquid oxygen pump, for accomplishing the pressure increase of the oxygen stream in the liquid state; and/or the low-pressure column does not have a top condenser.

Compared with the prior art, the technical solution provided by certain embodiments of the present invention has the following advantages:

Compared with two-column rectification in the prior art, the addition of the medium-pressure column to subject the high-pressure oxygen-rich liquid air to further low-temperature rectification after throttling, i.e. the use of three-column (one high-pressure column, one medium-pressure column and one low-pressure column) rectification increases the oxygen concentration of the medium-pressure oxygen-rich liquid air entering the low-pressure column for separation, improves the rectification conditions of the low-pressure column, and thereby increases the oxygen extraction rate and rectification efficiency of the low-pressure column.

Certain embodiments of the present invention fully tap the rectification potential of the rectification column, and through rational organization of the procedure, employs a three-column internal-compression procedure to produce low-purity oxygen, with energy consumption that is more than 15% lower than a conventional two-column procedure;

and the present invention is operationally simpler than the mixing of high-purity oxygen and air.

Certain embodiments of the present invention are suitable for the simultaneous production of pressurized nitrogen and pressurized oxygen (preferably, the output ratio of pressurized nitrogen to pressurized oxygen obtained is >1); in a conventional two-column procedure, a pressurized nitrogen product collected from the top of the lower column has a pressure of about 6 bar, whereas the high-pressure column in the three-column procedure of the present invention can satisfy the requirements of direct collection of a nitrogen product at a pressure exceeding 6 bar from the rectification column, with no need to add a nitrogen compressor.

By adjusting the flow rate of liquid nitrogen (the second nitrogen stream) that is refluxed from the upper region of the medium-pressure column to the top of the high-pressure column via the liquid nitrogen pump, the actual requirement of the user for pressurized nitrogen can be achieved, and such an operation will not affect the oxygen extraction rate of the low-pressure column.

BRIEF DESCRIPTION OF THE DRAWINGS

Further understanding of the advantages and spirit of the present invention can be gained through the following detailed description of the invention and the accompanying drawings.

FIG. 1 is a structural schematic diagram of the apparatus for producing high-purity nitrogen and low-purity oxygen provided in the present invention.

DETAILED DESCRIPTION OF THE INVENTION

To clarify the object, technical solution and advantages of embodiments of the present invention, the technical solution in embodiments of the present invention is described clearly and completely below in conjunction with the drawings. Obviously, the embodiments described are merely some, not all, of the embodiments of the present invention. Thus, the detailed description below of the embodiments of the present invention provided in the drawings is intended not to limit the scope of the present invention for which protection is claimed, but merely to represent selected embodiments of the present invention. All other embodiments obtained by those skilled in the art on the basis of embodiments of the present invention without any inventive effort are included in the scope of protection of the present invention.

In addition, the terms "first", "second" and "third" do not indicate a definition of chronological order, quantity or importance, but are merely intended to distinguish one technical feature in this technical solution from another technical feature. Similarly, qualifiers similar to "a" appearing herein do not indicate a definition of quantity, but describe a technical feature that has not appeared in the preceding text. Similarly, unless modified by a specific quantity measure word, nouns herein should be regarded as including both singular and plural forms, i.e. the technical solution may include a single one of the technical feature concerned, but may also include a plurality of the technical feature.

Unless stated otherwise, the terms "comprise" and "contain" used in the claims should not be understood as being limited to the approach set out thereafter, and do not rule out other elements or steps. They must be understood as stating that the feature, integer, step and/or component mentioned is present in the manner described, but do not rule out the existence and/or addition of one or more other feature, integer, step or component, or a set thereof. Thus, the scope of the expression "apparatus comprising x and z" should not be limited to an apparatus consisting of components x and z alone. In addition, the scope of the expression "method comprising steps x and z" should not be limited to a method consisting of these steps alone.

The components herein principally refer to interconnected process pipelines which are used to convey corresponding fluids and connected between the apparatuses, as well as instruments and valves, etc. arranged on the process pipelines.

Pressurized products (pressurized oxygen product, pressurized nitrogen product) are understood as being final products of the air separation apparatus, which are at a pressure at least 0.1 bar higher than atmospheric pressure. The pressurized oxygen of the present invention can substantially be obtained at the working pressure of a low-pressure column, or in the case of internal compression, an oxygen stream in the liquid state is collected from the bottom of the low-pressure column (at a low-pressure condensing evaporator) and undergoes a pressure increase in the liquid state to form liquid oxygen having a predetermined pressure, and evaporates or undergoes pseudo-evaporation at supercritical pressure by indirect heat exchange with feedstock air in a main heat exchanger, wherein a portion of the feedstock air is liquefied or undergoes pseudo-liquefaction at supercritical pressure.

The pressurized nitrogen of the present invention can substantially be obtained at the working pressure of a high-pressure column; a nitrogen stream in the gaseous state is collected from a top region of the high-pressure column, heated in the main heat exchanger and obtained as a high-pressure nitrogen product. When the nitrogen user needs nitrogen products at different pressures, it is also possible for multiple pressurized nitrogen products to be collected in different pressure columns. For example, acquisition at the working pressure of a medium-pressure column is also possible; another nitrogen stream in the gaseous state is collected from a top region of the medium-pressure column, heated in the main heat exchanger and obtained as a medium-pressure nitrogen product. In this way, nitrogen products at two pressures, specifically high-pressure nitrogen and medium-pressure nitrogen, are obtained at the same time.

The main heat exchanger is used for cooling compressed and purified feedstock air through indirect heat exchange with a reflux product from the rectification system for nitrogen/oxygen separation. The main heat exchanger may be formed of one or more heat exchange regions connected in parallel and/or series, e.g. formed of one or more plate-type heat exchanger sections. In the present invention, the reflux product used for cooling the compressed and purified feedstock air mainly comprises the oxygen stream, a first nitrogen stream and the waste nitrogen, wherein the oxygen stream is liquid oxygen, and the first nitrogen stream and the waste nitrogen are both gaseous.

A conventional two-column arrangement mainly consists of a high-pressure column and a low-pressure column. The purpose of the present invention is to provide a medium-pressure column between the high-pressure column and low-pressure column, with the operating pressure of the medium-pressure column being between that of the high-pressure column and that of the low-pressure column. Using this three-column rectification method, with the addition of the medium-pressure column, the high-pressure oxygen-rich liquid air collected from the bottom of the high-pressure column undergoes subcooling and throttling before being sent into the medium-pressure column for further low-temperature rectification, then medium-pressure oxygen-rich liquid air is obtained at the bottom of the medium-pressure column (at a medium-pressure condensing evaporator), and the medium-pressure oxygen-rich liquid air is then collected and subjected to subcooling and throttling before being sent into the low-pressure column for further rectification. In this way, the oxygen concentration of the oxygen-rich liquid air entering the low-pressure column for separation is increased, the rectification conditions of the low-pressure column are improved, and the oxygen extraction rate and rectification efficiency of the low-pressure column are thereby increased.

It must be explained that the low-pressure column, medium-pressure column and high-pressure column can be collectively referred to as the rectification column; and the low pressure, medium pressure and high pressure are defined according to different actual operating pressures. It can be made clear that the operating pressure of the medium-pressure column is between the operating pressures of the low-pressure column and high-pressure column, the operating pressure of the low-pressure column is the smallest of the operating pressures of the three columns, and the operating pressure of the high-pressure column is the largest of the operating pressures of the three columns. Preferably, the low-pressure column has an operating pressure of 1.1-1.5 bar, the medium-pressure column has an operating pressure of 4.5-6.5 bar, and the high-pressure column has an operating pressure of 8.5-9.5 bar, all of the above pressure values being absolute pressures.

The condensing evaporator is also a type of heat exchanger, in which a condensing first fluid and an evaporating second fluid undergo indirect heat exchange; each condensing evaporator has a liquefaction chamber and an evaporation chamber, which are formed of liquefaction channels or evaporation channels. Condensation (liquefaction) of the first fluid takes place in the liquefaction chamber; evaporation of the second fluid takes place in the evaporation chamber. The evaporation chamber and liquefaction chamber are formed of channel sets that are in a heat exchange relationship with each other.

In the present invention, the condensing evaporators comprise the medium-pressure condensing evaporator arranged in a lower region of the medium-pressure column, and the low-pressure condensing evaporator arranged in a lower region of the low-pressure column. In the medium-pressure condensing evaporator, medium-pressure oxygen-rich liquid air evaporates, and liquid nitrogen condenses. In the low-pressure condensing evaporator, liquid oxygen evaporates, and liquid nitrogen condenses. Preferably, the top of the low-pressure column in the present invention does not have a top condenser, and lean liquid nitrogen and medium-pressure oxygen-rich liquid air serve as reflux liquids of the low-pressure column; there is no colder fluid that can serve as condensate of the low-pressure column.

Specifically, in the present invention, feedstock air passing through a first pressurizer is pressurized to a first pressure air; the first pressure air undergoes pre-cooling and purification, and then a first portion is cooled in the main heat exchanger and led into a lower region of the high-pressure column, and a second portion of the first pressure air is pressurized in a second pressurizer to a second pressure; a first portion of the second pressure air is cooled in the main heat exchanger, collected from a middle position of the main heat exchanger and then passes through an expander to obtain the third pressure air, which is led into the lower region of the medium-pressure column; a second portion of the second pressure air is liquefied or undergoes pseudo-liquefaction at supercritical pressure in the main heat exchanger; one portion of the second portion of the second pressure air which has been liquefied or has undergone pseudo-liquefaction at supercritical pressure is led into the lower region of the high-pressure column; another portion of the second portion of the second pressure air which has been liquefied or has undergone pseudo-liquefaction at supercritical pressure passes through a high-pressure subcooler and is led into a middle region of the low-pressure column.

The present invention uses a split-flow method to pressurize the feedstock air. Firstly, pressure is utilized effectively, i.e. the pressure and flow rate of the feedstock air pressurizers are configured effectively, and the total air compressor shaft power is reduced; secondly, it is possible to satisfy the rectification conditions and heat exchange requirements of rectification columns at different pressures, thus reducing the total energy consumption of the apparatus and achieving an energy-saving result. The first portion of the first pressure air that is cooled in the main heat exchanger and led into the lower region of the high-pressure column converges with the portion of the second portion of the second pressure air which has been liquefied or has undergone pseudo-liquefaction at supercritical pressure and which is led into the lower region of the high-pressure column, flowing into the high-pressure column to undergo low-temperature rectification; the third pressure air obtained via the expander is led into the medium-pressure column, converging with the subcooled and throttled the high-pressure oxygen-rich liquid air and flowing into the medium-pressure column to undergo low-temperature rectification; the other portion of the second portion of the second pressure air, which has been liquefied or has undergone pseudo-liquefaction at supercritical pressure and is led into the low-pressure column via the high-pressure subcooler, is led into the low-pressure column, converging with the subcooled and throttled medium-pressure oxygen-rich liquid air and flowing into the low-pressure column to undergo low-temperature rectification.

In the main heat exchanger, the first pressure air and the second pressure air which are at a higher temperature exchange heat with the waste nitrogen, pressurized nitrogen, and liquid oxygen having the predetermined pressure, which are at a lower temperature. In the high-pressure subcooler, the other portion of the second portion of the second pressure air, which has been liquefied or has undergone pseudo-liquefaction at supercritical pressure, exchanges heat with a second nitrogen stream that has undergone a pressure increase in a liquid nitrogen pump and with the liquid oxygen having the predetermined pressure, recovering the cold of the second nitrogen stream and liquid oxygen. In a low-pressure subcooler, the high-pressure oxygen-rich liquid air, medium-pressure oxygen-rich liquid air and lean liquid nitrogen exchange heat with the waste nitrogen, recovering the cold of the waste nitrogen.

In actual applications, a liquid oxygen pump might be unable to operate normally due to a long period of running; the liquid oxygen pump comprises at least two liquid oxygen pumps, one of which is a standby liquid oxygen pump, used for taking over operation when one of the liquid oxygen pumps is unable to operate normally. The liquid oxygen pump may be a pressure-adjustable liquid oxygen pump or a fixed-pressure liquid oxygen pump; the pressure of a fixed-pressure liquid oxygen pump can be selected according to the actual requirements of a user, whereas a pressure-adjustable liquid oxygen pump is generally for users who need oxygen at different pressures, thus the scope of application of the apparatus is expanded, and the actual requirements of different users are met. Moreover, as at least two liquid oxygen pumps are generally provided, when one of these develops a fault and stops operating, the other standby liquid oxygen pump can be started up immediately, so as to ensure that the apparatus can still operate normally.

By the same principle, the liquid nitrogen pump might be unable to operate normally due to a long period of running; the liquid nitrogen pump comprises at least two liquid nitrogen pumps, one of which is a standby liquid nitrogen pump, used for taking over operation when one of the liquid nitrogen pumps is unable to operate normally. The pressure of the liquid nitrogen pump can be selected according to the operating pressures of the medium-pressure column and high-pressure column; the flow rate of the liquid nitrogen pump is closely related to the reflux liquid of the high-pressure column, and this expands the scope of application of the apparatus. When the actual requirement of a user for the pressurized nitrogen product led out of the high-pressure column increases, this can be achieved by increasing the flow rate of liquid nitrogen refluxed to the top of the high-pressure column from the medium-pressure column via the liquid nitrogen pump; and when the actual requirement of a user for the pressurized nitrogen product led out of the high-pressure column decreases, this can be achieved by reducing the flow rate of this reflux liquid. It must also be emphasized that such operations will not affect the oxygen extraction rate of the low-pressure column.

Compared with the prior art, in the apparatus for producing high-purity nitrogen and low-purity oxygen provided in embodiments of the present invention, by adding the medium-pressure column to subject the high-pressure oxygen-rich liquid air to further low-temperature rectification, the oxygen concentration of the oxygen-rich liquid air entering the low-pressure column after throttling of the medium-pressure oxygen-rich liquid air is increased, the rectification conditions of the low-pressure column are improved, and the oxygen extraction rate and rectification efficiency of the low-pressure column are thereby increased. At the same time, due to the fact that liquid oxygen is continuously extracted from the low-pressure condensing evaporator, accumulation of hydrocarbons is prevented, thus ensuring the safety and reliability of the apparatus.

Particular embodiments of the present invention are explained in detail below in conjunction with FIG. 1.

Feedstock air 1 is filtered and drawn in by a first pressurizer 14, and is compressed in the first pressurizer 14 to a first pressure, which is preferably about 9 bar. Having then undergone pre-cooling and purification (not shown in the figure), the feedstock air 1 is split into two portions, wherein a first portion of the first pressure air 2 is cooled to close to dew point in a main heat exchanger 19, and then led into a lower region of a high-pressure column 24 to undergo separation; a second portion of the first pressure air is pressurized in a second pressurizer 15 to form the second pressure air 3, wherein the second pressure is preferably about 17 bar.

The second pressure air 3 is split into two portions, wherein a first portion of the second pressure air is cooled in the main heat exchanger 19 and collected from a middle position of the main heat exchanger 19, and then passes through an expander 16 to obtain the third pressure air 4 which is led into a lower region of a medium-pressure column 25, wherein the pressure of the third pressure air 4 is the same as the operating pressure of the medium-pressure column 25; preferably, the third pressure is about 6 bar. A second portion of the second pressure air is liquefied or undergoes pseudo-liquefaction at supercritical pressure in the main heat exchanger 19. Having been liquefied or having undergone pseudo-liquefaction at supercritical pressure, the second portion of the second pressure air is split into two portions, wherein one portion of the second portion of the second pressure air 5 which has been liquefied or has undergone pseudo-liquefaction at supercritical pressure is throttled to about 9 bar, and is led into the lower region of the high-pressure column 24; another portion of the second portion of the second pressure air 6 which has been liquefied or has undergone pseudo-liquefaction at supercritical pressure passes through a high-pressure subcooler 21 and is throttled to about 1.5 bar, and is then led into a middle region of a low-pressure column 26.

The first portion of the first pressure air 2 led into the lower region of the high-pressure column 24 converges with the portion of the second portion of the second pressure air 5 which has been liquefied or has undergone pseudo-liquefaction at supercritical pressure and which is led into the lower region of the high-pressure column 24, flowing into the high-pressure column 24 to undergo low-temperature rectification. The operating pressure of the high-pressure column 24 is about 9 bar, and the main products thereof include a first nitrogen stream 13 and the high-pressure oxygen-rich liquid air 7 at the bottom; the first nitrogen stream 13 is collected from a top region of the high-pressure column 24, is heated in the main heat exchanger 19 to approximately ambient temperature, and is obtained as a nitrogen product at a pressure of about 8.5 bar. In a conventional two-column procedure, a pressurized nitrogen product collected from the top of the lower column has a pressure of about 6 bar; in the three-column procedure of the present invention, the high-pressure column can satisfy a scenario in which a nitrogen product at a pressure exceeding 6 bar is collected directly from the rectification column, with no need to add a nitrogen compressor. The high-pressure oxygen-rich liquid air 7 collected from the bottom of the high-pressure column 24 passes through a low-pressure subcooler 20 and then undergoes throttling, being led into a middle region of the medium-pressure column 25.

The third pressure air 4 obtained via the expander 16 converges with the subcooled and throttled the high-pressure oxygen-rich liquid air 7, flowing into the medium-pressure column 25 to undergo low-temperature rectification. The medium-pressure column 25 has an operating pressure of about 6 bar, and is mainly used for further rectification of the high-pressure oxygen-rich liquid air 7, with medium-pressure oxygen-rich liquid air then being obtained at the bottom of the medium-pressure column 25 (at a medium-pressure condensing evaporator 23); the medium-pressure oxygen-rich liquid air 8 is then collected, then passes through the low-pressure subcooler 20 and undergoes throttling before being sent into the low-pressure column 26 to undergo further rectification. At the same time, lean liquid nitrogen 9 is obtained from the middle region of the medium-pressure column 25, passes through the low-pressure subcooler 20 and then undergoes throttling before being sent into an upper region of the low-pressure column 26. It must be emphasized that a second nitrogen stream 10 is collected from an upper region of the medium-pressure column 25, passes sequentially through a liquid nitrogen pump 17 and the high-pressure subcooler 21 and is led into the top region of the high-pressure column 24 as a reflux liquid of the high-pressure column 24.

The other portion of the second portion of the second pressure air 6, which has been liquefied or has undergone pseudo-liquefaction at supercritical pressure and is led into the low-pressure column 26 via the high-pressure subcooler 21, converges with the medium-pressure oxygen-rich liquid air 8 and the lean liquid nitrogen 9, flowing into the low-pressure column to undergo low-temperature rectification. The operating pressure of the low-pressure column 26 is about 1.5 bar; pressurized oxygen can substantially be obtained at the working pressure of the low-pressure column 26, or in the case of internal compression, an oxygen stream 11 in the liquid state is collected from the bottom of the low-pressure column 26 (at a low-pressure condensing evaporator 22) and passes through a liquid oxygen pump 18 in the liquid state to form liquid oxygen having a predetermined pressure, and evaporates or undergoes pseudo-evaporation at supercritical pressure by indirect heat exchange with feedstock air in the main heat exchanger 19, being obtained as an oxygen product of 93% purity at a pressure of 6 bar. At the same time, the waste nitrogen 12 is collected in the gaseous state from a top region of the low-pressure column 26 and heated in the main heat exchanger 19, and served as regenerated gas or is vented.

In the high-pressure subcooler 21, the other portion of the second portion of the second pressure air 6, which has been liquefied or has undergone pseudo-liquefaction at supercritical pressure, exchanges heat with the liquid nitrogen 10 that has undergone a pressure increase in the liquid nitrogen pump and with the liquid oxygen 11 having the predetermined pressure, recovering the cold of the liquid nitrogen 10 and liquid oxygen 11. In the low-pressure subcooler 20, the high-pressure oxygen-rich liquid air 7, medium-pressure oxygen-rich liquid air 8 and lean liquid nitrogen 9 exchange heat with the waste nitrogen 12, recovering the cold of the waste nitrogen 12.

Finally, it should be explained that the embodiments above are merely particular embodiments of the present invention, which are intended to explain the technical solution of the present invention without limiting it, and the scope of protection of the present invention is not limited to this. Although the present invention has been explained in detail with reference to the above embodiments, those skilled in the art should understand that: any person skilled in the art could, within the technical scope disclosed in the present invention, still make amendments or readily conceivable changes to the technical solution recorded in the above embodiments, or make equivalent substitutions of a portion of the technical features therein; and such amendments, changes or substitutions would not cause the substance of the corresponding technical solution to depart from the spirit and scope of the technical solution of the embodiments of the present invention, and should all be included in the scope of protection of the present invention. Thus, the scope of protection of the present invention should be considered to be the scope of protection stated in the claims.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, language referring to order, such as first and second, should be understood in an exemplary sense and not in a limiting sense. For example, it can be recognized by those skilled in the art that certain steps can be combined into a single step.

The singular forms "a", "an", and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

We claim:

1. A method for producing high-purity nitrogen and low-purity oxygen, the method comprising the steps of:

cooling feedstock air in a main heat exchanger and then introducing the feedstock air into a rectification system for nitrogen/oxygen separation, the rectification system having at least a high-pressure column and a low-pressure column;

collecting an oxygen stream from a lower region of the low-pressure column, heating the oxygen stream in the main heat exchanger, and then obtaining the oxygen stream as a pressurized oxygen product;

collecting a first nitrogen stream from a top region of the high-pressure column, heating the first nitrogen stream in the main heat exchanger, and obtaining the first nitrogen stream as a pressurized nitrogen product;

collecting waste nitrogen in a gaseous state from a top region of the low-pressure column and heating the waste nitrogen in the main heat exchanger, before using as regenerated gas or venting; and providing a medium-pressure column between the high-pressure column and low-pressure column, with an operating pressure of the medium-pressure column being between that of the high-pressure column and that of the low-pressure column, wherein the lower region of the low-pressure column has a low-pressure condensing evaporator, wherein a lower region of the medium-pressure column has a medium-pressure condensing evaporator, wherein the rectification system comprises a high-pressure subcooler and a low-pressure subcooler, wherein the feedstock air passing through a first pressurizer is pressurized to a first pressure air, and then a first portion of the first pressure air is cooled in the main heat exchanger and led into a lower region of the high-pressure column, and a second portion of the first pressure air is pressurized in a second pressurizer to a second pressure air;

wherein a first portion of the second pressure air is cooled in the main heat exchanger and collected from a middle position of the main heat exchanger, and then passes through an expander to obtain a third pressure air which is led into the lower region of the medium-pressure column, and a second portion of the second pressure air is liquefied or undergoes pseudo-liquefaction in the main heat exchanger, wherein one portion of the second portion of the second pressure air which has been liquefied or has undergone pseudo-liquefaction is led into the lower region of the high-pressure column, wherein another portion of the second portion of the second pressure air which has been liquefied or has undergone pseudo-liquefaction passes through the high-pressure subcooler and is led into a middle region of the low-pressure column, wherein high-pressure oxygen-rich liquid air is collected from the bottom of the high-pressure column, passes through the low-pressure subcooler and is then throttled and led into a middle region of the medium-pressure column; medium-pressure oxygen-rich liquid air is collected from the medium-pressure condensing evaporator, passes through the low-pressure subcooler and is then throttled and led into the lower region of the low-pressure column; lean liquid nitrogen is collected from the middle region of the medium-pressure column, passes through the low-pressure subcooler and is then throttled and led into an upper region of the low-pressure column, and wherein a second nitrogen stream is collected from an upper region of the medium-pressure column, undergoes a pressure increase in the liquid state, passes through the high-pressure subcooler and is led into the top region of the high-pressure column.

2. The method according to claim 1, wherein the pressure increase of the second nitrogen stream in the liquid state is accomplished by a liquid nitrogen pump.

3. The method according to claim 1, wherein the oxygen stream is collected in the liquid state from the lower region of the low-pressure column, undergoes a pressure increase in the liquid state, and evaporates or undergoes pseudo-evaporation by indirect heat exchange with the feedstock air in the main heat exchanger.

4. The method according to claim 3, wherein the pressure increase of the oxygen stream in the liquid state is accomplished by a liquid oxygen pump.

5. The method according to claim 1, wherein the pressurized oxygen product has a purity of 93%-99%.

6. The method according to claim 1, wherein the low-pressure column has an operating pressure of 1.1-1.5 bar, the medium-pressure column has an operating pressure of 4.5-6.5 bar, and the high-pressure column has an operating pressure of 8.5-9.5 bar, all of the above pressure values being absolute pressures.

7. An apparatus for producing high-purity nitrogen and low-purity oxygen, the apparatus having a rectification system for nitrogen/oxygen separation, and the rectification system having at least a high-pressure column and a low-pressure column, the apparatus further comprising:

a. a main heat exchanger configured to cool compressed and purified feedstock air;

b. a first component configured to collect an oxygen stream from a lower region of the low-pressure column, the oxygen stream being heated in the main heat exchanger and obtained as a pressurized oxygen product;

c. a second component configured to collect a first nitrogen stream from a top region of the high-pressure column, the first nitrogen stream being heated in the main heat exchanger and obtained as a pressurized nitrogen product;

d. a third component configured to collect a waste nitrogen in the gaseous state from a top region of the low-pressure column, the waste nitrogen being heated in the main heat exchanger, and serving as regenerated gas or being vented;

e. a medium-pressure column, arranged between the high-pressure column and the low-pressure column;

f. a low-pressure condensing evaporator, arranged at the lower region of the low-pressure column;

g. a medium-pressure condensing evaporator, arranged at a lower region of the medium-pressure column;

h. a first pressurizer configured to pressurize the feedstock air to a first pressure;

i. a fourth component configured to introduce a first portion of the first pressure air into a lower region of the high-pressure column after being cooled in the main heat exchanger;

j. a second pressurizer configured to pressurize a second portion of the first pressure air to a second pressure to form a second pressure air;

k. an expander configured to expand a first portion of the second pressure air to a third pressure to form a third pressure air;

l. a fifth component configured to introduce the third pressure air into the lower region of the medium-pressure column;

m. a sixth component configured to subject a second portion of the second pressure air to liquefaction or pseudo-liquefaction;

n. a seventh component configured to introduce one portion of the second portion of the second pressure air which has been liquefied or has undergone pseudo-liquefaction into the lower region of the high-pressure column;

o. an eighth component configured to introduce another portion of the second portion of the second pressure air which has been liquefied or has undergone pseudo-liquefaction through a high-pressure subcooler and into a middle region of the low-pressure column;

p. a low-pressure subcooler configured to subcool a high-pressure oxygen-rich liquid air, medium-pressure oxygen-rich liquid air and lean liquid nitrogen;

q. a high-pressure subcooler configured to subcool the another portion of the second portion of the second pressure air which has been liquefied or has undergone pseudo-liquefaction;

r. a ninth component configured to collect the high-pressure oxygen-rich liquid air from the bottom of the high-pressure column, passing the high-pressure oxygen-rich liquid air through the low-pressure subcooler, throttling the high-pressure oxygen-rich liquid air and then leading the high-pressure oxygen-rich liquid air into a middle region of the medium-pressure column;

s. a tenth component configured to collect the medium-pressure oxygen-rich liquid air from the medium-pressure condensing evaporator, passing the medium-pressure oxygen-rich liquid air through the low-pressure subcooler, throttling the medium-pressure oxygen-rich liquid air and the leading the medium-pressure oxygen-rich liquid air into the lower region of the low-pressure column;

t. an eleventh component configured to collect the lean liquid nitrogen from the middle region of the medium-pressure column, passing the lean liquid nitrogen through the low-pressure subcooler, throttling the lean liquid nitrogen and the leading the lean liquid nitrogen into an upper region of the low-pressure column; and u. a twelfth component configured to collect a second nitrogen stream from an upper region of the medium-pressure column, subjecting the second nitrogen stream to a pressure increase in the liquid state, passing the second nitrogen stream through the high-pressure subcooler and then leading the second nitrogen stream into the top region of the high-pressure column.

8. The apparatus for producing the high-purity nitrogen and the low-purity oxygen according to claim 7, further comprising a liquid nitrogen pump configured to increase the pressure of the second nitrogen stream in the liquid state.

9. The apparatus for producing the high-purity nitrogen and the low-purity oxygen according to claim 7, further comprising a liquid oxygen pump configured to increase the pressure of the oxygen stream in the liquid state.

10. The apparatus for producing the high-purity nitrogen and the low-purity oxygen according to claim 7, wherein the low-pressure column does not have a top condenser.

* * * * *